US009559477B2

(12) United States Patent
Liu et al.

(10) Patent No.: US 9,559,477 B2
(45) Date of Patent: Jan. 31, 2017

(54) CONNECTOR AND METHOD FOR IMPLEMENTING THE CONNECTOR

(71) Applicant: Goertek, Inc., Weifang, ShanDong Province (CN)

(72) Inventors: Song Liu, Weifang (CN); Chengxin Xu, Weifang (CN)

(73) Assignee: Goertek, Inc., Weifang, Shandong Province (CN)

( * ) Notice: Subject to any disclaimer, the term of this patent is extended or adjusted under 35 U.S.C. 154(b) by 0 days.

(21) Appl. No.: 14/901,596

(22) PCT Filed: Jul. 30, 2015

(86) PCT No.: PCT/CN2015/085580
§ 371 (c)(1),
(2) Date: Dec. 28, 2015

(87) PCT Pub. No.: WO2016/086676
PCT Pub. Date: Jun. 9, 2016

(65) Prior Publication Data

US 2016/0301172 A1 Oct. 13, 2016

(30) Foreign Application Priority Data

Dec. 3, 2014 (CN) ..... 2014 1 0728349

(51) Int. Cl.
*H01R 11/30* (2006.01)
*H01R 39/10* (2006.01)
(Continued)

(52) U.S. Cl.
CPC ..... *H01R 39/10* (2013.01); *H01R 13/6205* (2013.01); *H01R 24/58* (2013.01); *H01R 43/20* (2013.01)

(58) Field of Classification Search
CPC ..... H01R 11/30; H01R 13/6205
See application file for complete search history.

(56) References Cited

U.S. PATENT DOCUMENTS 3,521,216 A * 7/1970 Manuel ..... H01R 13/6205 439/152
3,808,577 A * 4/1974 Mathauser ..... H01R 13/6205 439/180
(Continued)

FOREIGN PATENT DOCUMENTS

CN 103545675 1/2014

OTHER PUBLICATIONS

PCT/CN2015/085580,Written Opinion of the International Searching Authority dated Sep. 29, 2015, 5 pages and English Translation, 4 pages.

*Primary Examiner* — Tho D Ta
(74) *Attorney, Agent, or Firm* — Boyle Fredrickson, S.C.

(57) ABSTRACT

The invention discloses a connector and a method for implementing the connector. The connector includes a power source socket, and a power source plug mating with the power source socket, wherein annular or circular electrode sheets are arranged on the power source socket, and one or more pairs of positive and negative terminals are positioned correspondingly on the power source plug, so that when the power source plug is inserted into the power source socket in any direction or at any angle, the positive and negative terminals can come into contact with the annular or circular electrode sheets to thereby electrically connect the power source plug with the power source socket; and in a preferred embodiment, an earphone jack is positioned at the center of the power source socket so that the connector can operate as both the earphone jack and the power source socket to thereby make use of the space effectively so as to lower the number of interfaces via which a device is connected externally, thus making the device simpler in appearance.

13 Claims, 4 Drawing Sheets

(51) Int. Cl.

| | |
|---|---|
| ***H01R 13/62*** | (2006.01) |
| ***H01R 24/58*** | (2011.01) |
| ***H01R 43/20*** | (2006.01) |

(56) References Cited

U.S. PATENT DOCUMENTS

| | | | | |
|---|---|---|---|---|
| 3,810,258 | A * | 5/1974 | Mathauser | H01R 13/6205 439/246 |
| 7,056,127 | B2 * | 6/2006 | Suzuki | H01R 13/6205 439/22 |
| 7,789,667 | B2 * | 9/2010 | Zhu | H01R 13/6205 439/271 |
| 8,398,409 | B2 * | 3/2013 | Schmidt | H01R 11/30 439/39 |
| 8,602,795 | B2 * | 12/2013 | Hsu | H01R 13/6205 439/39 |
| 2013/0303000 | A1 * | 11/2013 | Witter | H01R 13/6205 439/39 |
| 2014/0120746 | A1 * | 5/2014 | Persion | G02B 6/3817 439/39 |
| 2015/0093919 | A1 * | 4/2015 | McBroom | H01R 24/38 439/39 |

* cited by examiner

CONNECTOR AND METHOD FOR IMPLEMENTING THE CONNECTOR

FIELD

The present invention relates to the field of electronics, and particularly to a connector and a method for implementing the connector.

BACKGROUND

An existing connector like power source plug when needed to be connected to a terminal body has to be inserted into a power source socket of the terminal body at a specific angle, and if the power source plug is inserted at another angle, then it may fail to be inserted into the power source socket, thus resulting in low flexibility and poor convenience of the power source plug, which may cause inconvenience for a user to use the power source plug. For example, if there is such low illumination or the terminal is so placed that the user can not see the power source plug clearly, then it often leads to the problem that the power source plug fails to be inserted into the power source socket, and if the user inserts and pulls out the power source plug frequently, then the power source socket in the terminal body and the power source plug may tend to be scratched or worn, thus degrading the service life thereof.

SUMMARY

The invention provides a connector and a method for implementing the connector so as to address such a problem in the prior art that the power source plug has to operate in cooperation with the power source socket in a specific direction or at a specific angle, thus resulting low flexibility and poor convenience thereof.

In order to attain the object above, technical solutions according to embodiments of the invention are as follows:

In an aspect, an embodiment of the invention provides a connector including a power source socket, and a power source plug mating with the power source socket, wherein electrodes of the power source socket are annular or circular electrode sheets, and one or more pairs of positive and negative terminals are arranged on the power source plug in positions corresponding to the annular or circular electrode sheets of the power source socket; and when the power source plug is inserted into the power source socket in any direction or at any angle, the positive and negative terminals come into contact with the annular or circular electrode sheets to thereby electrically connect the power source plug with the power source socket.

Preferably the electrodes of the power source socket of the connector are annular electrode sheets, and a spare jack is arranged at the center of the power source socket.

In a preferred technical solution, the spare jack is an earphone jack, and an earphone plug is arranged on the power source plug in a position corresponding to the earphone jack; and when the earphone plug is inserted into the earphone jack, the earphone plug is electrically connected with the earphone jack, or the power source plug is mechanically connected with the power source socket.

Preferably the power source plug includes a circular through-hole structure mating with the spared jack.

In another preferred technical solution, the spare jack is an earphone jack, and when an external earphone plug is inserted into the earphone jack through the circular through-hole structure of the power source plug, the earphone plug is electrically connected with the earphone jack, or the power source plug is mechanically connected with the power source socket.

Preferably a protruding section protruding from the bottom surface of the power source socket is arranged on the spare jack, wherein a projection is arranged on a side of the protruding section, a groove is arranged on a side of the circular through-hole structure in a position corresponding to the projection, when the projection is engaged with the groove, the power source plug is mechanically connected with the power source socket.

Preferably the power source socket and the power source plug are magnetically connected, wherein a permanent magnet or an electromagnet is arranged on the power source plug and/or the power source socket.

Preferably the electrodes of the power source socket are a plurality of concentrically arranged of annular electrode sheets, each of which corresponds to a polarity type, and an insulation layer is arranged between two adjacent annular electrode sheets of different polarity types; and positive terminals are arranged on the power source plug in positions corresponding to a positive annular electrode sheet of the plurality of annular electrode sheets; and negative terminals are arranged on the power source plug in positions corresponding to a negative annular electrode sheet of the plurality of annular electrode sheets.

Preferably the annular or circular electrode sheets are located on a bottom plane where the power source socket is located; or the annular electrode sheets are positioned encircling side of the power source socket.

Preferably the positive and negative terminals are retractable; and the positive and negative terminals come into contact with the annular or circular electrode sheets uniformly and symmetrically.

Based upon the technical solution above, the power source socket is arranged on a body of a terminal device including a sound box.

In another aspect, an embodiment of the invention provides a method for implementing a connector, the method including:

arranging electrodes of a power source socket as annular or circular electrode sheets;

arranging one or more pairs of positive and negative terminals on the power source plug in positions corresponding to the annular or circular electrode sheets of the power source socket; and inserting the power source plug into the power source socket in any direction or at any angle so that the positive and negative terminals come into contact with the annular or circular electrode sheets to thereby electrically connect the power source plug with the power source socket.

Preferably when the electrodes of the power source socket of the connector are annular electrode sheets, the method further includes: arranging a spare jack at the center of the power source socket.

Preferably the method further includes: arranging a permanent magnet or an electromagnet on the power source plug and/or the power source socket so that the power source socket and the power source plug are magnetically connected.

Preferably when the electrodes of the power source socket are a plurality of concentrically arranged annular electrode sheets, the method further includes:

making each of the annular electrode sheets corresponding to a polarity type, and arranging an insulation layer between two adjacent annular electrode sheets of different polarity types; and the arranging one or more pairs of positive and negative terminals on the power source plug in positions corresponding to the annular electrode sheets of the power source socket includes:

arranging positive terminals on the power source plug in positions corresponding to a positive annular electrode sheet of the plurality of annular electrode sheets; and arranging negative terminals on the power source plug in positions corresponding to a negative annular electrode sheet of the plurality of annular electrode sheets.

An advantageous effect of the embodiments of the invention lies in that the invention provides a connector and a method for implementing the connector, where the connector is arranged with the annular or circular electrode sheets on the power source socket, and one or more pairs of positive and negative terminals are arranged correspondingly on the power source plug, so that if the power source plug is inserted into the power source socket in any direction or at any angle, then the positive and negative terminals can come into contact with the annular or circular electrode sheets to thereby electrically connect the power source plug with the power source socket.

In a preferred embodiment of the invention, if the electrodes of the power source socket are annular electrode sheets, then the earphone jack is positioned at the center of the power source socket so that the connector can operate as both the earphone jack and the power source socket to thereby make use of the device effectively, reduce the number of external interfaces of the device, thus making the device simpler in appearance.

BRIEF DESCRIPTION OF THE DRAWINGS

The drawings are intended to provide further understanding of the invention, and constitute a part of the specification, and serve together with the embodiments of the invention to explain the invention, but are not intended to limit the invention. In the drawings.

DETAILED DESCRIPTION OF THE EMBODIMENTS

In order to make the object, technical solutions, and advantages of the invention more apparent, the embodiments of the invention will be described below in further details with reference to the drawings.

Figure 1:
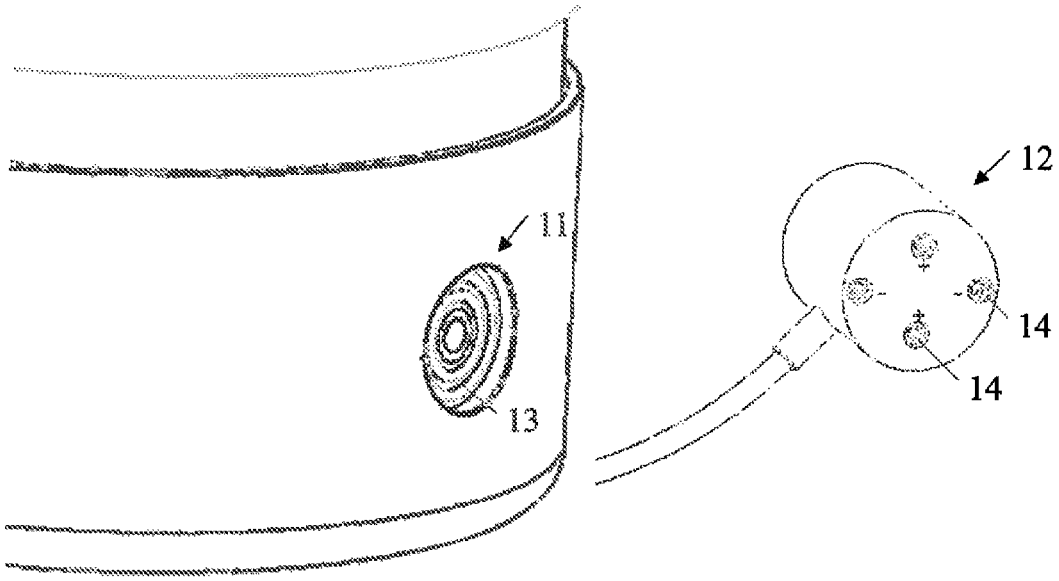
FIG. 1 illustrates a schematic diagram of a connector according to an embodiment of the invention.

FIG. 1 illustrates a schematic diagram of a connector according to an embodiment of the invention, where the connector includes a power source socket 11, and a power source plug 12 mating with the power source socket 11, electrodes of the power source socket 11 are annular or circular electrode sheets 13, and the power source plug 12 is arranged with one or more pairs of positive and negative terminals 14 at such positions corresponding to the annular or circular electrode sheets 13 of the power source socket 11 where the power source plug comes into contact with the electrode sheets 13 after the power source plug is inserted into the power source socket; and when the power source plug 12 is inserted into the power source socket 11 in any direction or at any angle, the positive and negative terminals 14 come into contact with the annular or circular electrode sheets 13, and the power source plug 12 is electrically connected with the power source socket 11.

Figure 2:
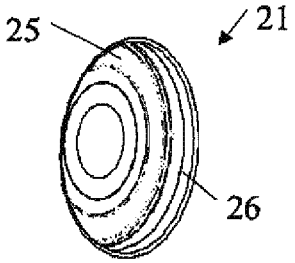
FIG. 2 illustrates a schematic diagram of annular electrode sheets positioned encircling the side of a power source socket according to an embodiment of the invention.

As illustrated in FIG. 2, there is illustrated a schematic diagram of annular electrode sheets positioned encircling the side of a power source socket according to an embodiment of the invention. The annular or circular electrode sheets can be located in a bottom plane 25 where a power source socket 21 is located, to thereby make full use of a space where the power source socket 21 is located, or the annular electrode sheets can be positioned encircling the side 26 of the power source socket 21 to thereby lower the size of the power source socket so as to make the connector more compact in structure.

Preferably the positive and negative terminals 14 come into contact with the annular or circular electrode sheets 13 uniformly and symmetrically to thereby improve the stability of connection between the power source plug and the power source socket. Referring to FIG. 1, among a plurality of terminals (e.g., four terminals) in contact with each electrode sheet, there is an even distance between every adjacent two terminals, or there is an even corresponding central angle between every adjacent two of these terminals.

It shall be noted that the positive and negative terminals 14 can be springs or pins or of another engagement type; and the annular or circular electrode sheets 13 can be contact-type metal pads; the embodiment of the invention will not be limited to any particular engagement type of the positive and negative terminals or material of the annular or circular electrode sheets as long as they can be particularly selected for an application.

In the connector according to this embodiment, the annular or circular electrode sheets are arranged on the power source socket so that the positive and negative terminals can come into contact with the annular or circular electrode sheets while the power source plug is inserted into the power source socket in any direction or at any angle, to thereby electrically connect the power source plug with the power source socket.

In a preferred embodiment, the electrodes of the power source socket of the connector are annular electrode sheets, and a spare jack is positioned at the center of the power source socket.

Figure 3:
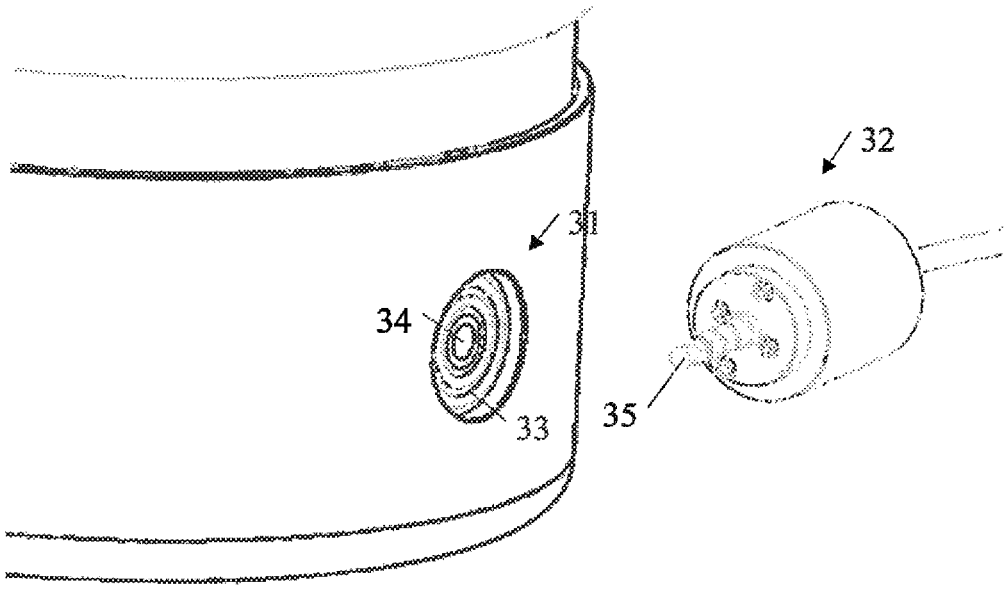
FIG. 3 illustrates a schematic diagram of a connector with an earphone jack positioned at the center of the power source socket according to an embodiment of the invention.

Preferably the spare jack is arranged as an earphone jack 34, and an earphone plug 35 is arranged on the power source plug 32 in a position corresponding to the earphone jack 34, as illustrated in FIG. 3, where there is illustrated a schematic diagram of a connector with an earphone jack positioned at the center of the power source socket according to an embodiment of the invention. When the earphone plug 35 is inserted into the earphone jack 34, the earphone plug 35 is electrically connected with the earphone jack 34, and also the power source plug 32 is mechanically connected with the power source socket 31. In this way, audio data can be transmitted using the spare jack, and also the power source plug can be installed and fixed onto the power source socket using the spare jack.

In this embodiment, the earphone jack is positioned at the center of the power source socket, and the earphone plug is arranged on the power source plug in a position corresponding to the earphone jack, so that the connector can operate as both the earphone jack and the power source socket to thereby make use of the space effectively, reduce the number of external interfaces of the device, thus making the device simpler in appearance.

Of course, the power source plug end can alternatively be provided with a mechanical structure of no electrical function but only similar to the earphone plug, so that when the power source plug is inserted into the power source socket, the power source plug 32 will be electrically connected with the power source socket 31 due to the engagement structure similar to that of the earphone plug, and at this time the earphone plug 35 and the earphone jack 34 can only operate for the purpose of connection but will not transmit audio data.

In another preferred embodiment, the power source plug includes a circular through-hole structure mating with the spared jack.

Figure 4:
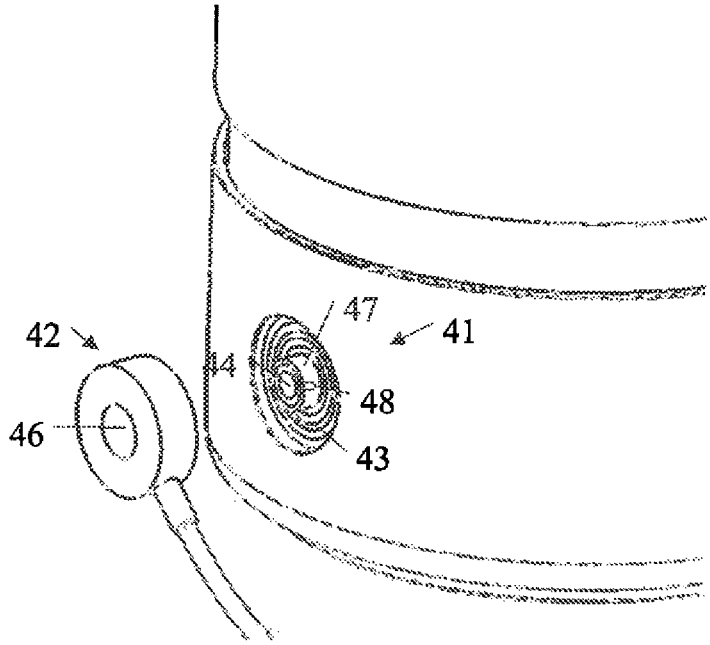
FIG. 4 illustrates a schematic diagram of a connector with a power source plug including a circular through-hole structure according to an embodiment of the invention.

As illustrated in FIG. 4, there is illustrated a schematic diagram of a connector with a power source plug including a circular through-hole structure according to an embodiment of the invention. Electrodes of a power source socket 41 of the connector are annular electrode sheets 43, a spare jack 44 is positioned at the center of the power source socket 41, and the power source plug 42 includes a circular through-hole structure 46 mating with the spare jack 44.

Figure 5:
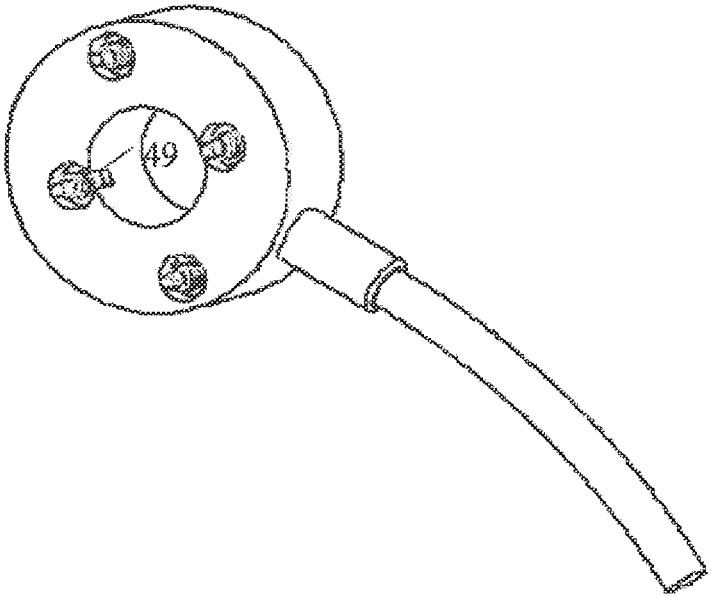
FIG. 5 illustrates a schematic diagram of the power source plug including the circular through-hole structure according to an embodiment of the invention.
Figure 6:
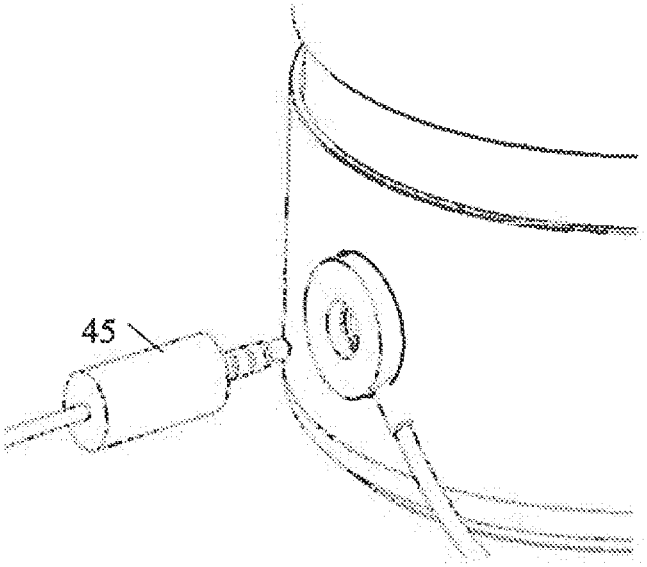
FIG. 6 illustrates a schematic diagram of an external earphone plug inserted into the earphone jack positioned at the center of the connector according to an embodiment of the invention.

As illustrated in FIG. 4 to FIG. 6 together, preferably the spare jack is arranged as an earphone jack 44, and when an external earphone plug 45 is inserted into the earphone jack 44 through the circular through-hole structure 46 of the power source plug 42, the earphone plug 45 is electrically connected with the earphone jack 44.

In this embodiment, the power source plug is arranged with the circular through-hole structure so that the external earphone plug is inserted into the earphone jack through the circular through-hole structure of the power source plug, thus providing additional cooperation manner between the connector and the earphone so that the connector can operate as both the earphone jack and the power source socket to thereby make use of the space effectively, reduce the number of external interfaces of the device, thus making the device simpler in appearance. Also the circular through-hole structure also makes sure the earphone plug can be inserted into the jack at any angle/in any direction.

Referring to FIG. 6, even if the annular power source plug with the circular through-hole structure is inserted into the power source socket, the external earphone plug 45 can still be inserted into the earphone socket through the circular hole of the annular power source plug to perform transmission of audio data normally.

Preferably referring to FIG. 4, the spare jack in this embodiment includes such a protruding section 47 protruding from the bottom surface of the power source socket 41 that the earphone jack 44 can mate with a plurality of types of earphone plugs 45 to thereby ensure the earphone plug 45 to be completely inserted into the earphone jack 44 so that the earphone plug 45 is electrically connected with the earphone jack 44, and also the power source plug 42 is mechanically connected with the power source socket 41.

Further preferably a projection 48 is arranged on the side of the protruding section 47, and a groove 49 is arranged on the side of the circular through-hole structure 46 in a position corresponding to the projection 48 (see FIG. 5), where the projection 48 is engaged with the groove 49 to thereby improve the stability of mechanical connection between the power source plug 42 and the power source socket 41.

In an embodiment of the invention, the electrodes of the power source socket are a plurality of concentrically arranged annular electrode sheets, each of which corresponds to a polarity type, where an insulation layer is arranged between two adjacent annular electrode sheets of different polarity types, and positive terminals are arranged on the power source plug in positions corresponding to a positive annular electrode sheet, whereas negative terminals are arranged on the power source plug in positions corresponding to a negative annular electrode sheet. This arrangement including a plurality of electrode sheets can both improve the flexibility of the connector and ensure the stability of the electrical connection.

Figure 7:
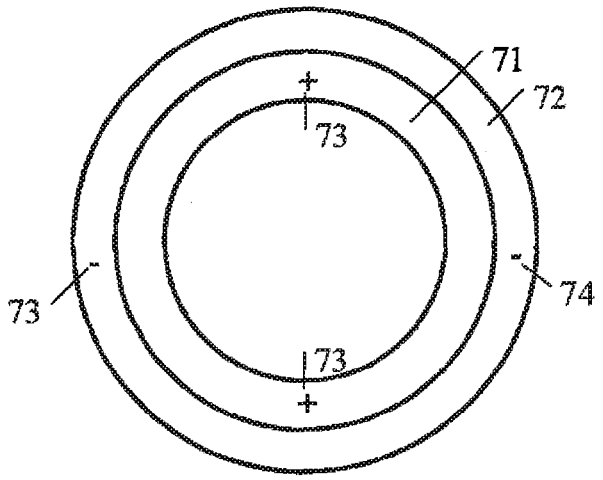
FIG. 7 illustrates a schematic diagram of annular electrode sheets coming into contact with positive and negative terminals at corresponding positions according to an embodiment of the invention.

FIG. 7 illustrates a schematic diagram of annular electrode sheets coming into contact with positive and negative terminals at corresponding positions according to an embodiment of the invention, where a pair of positive terminals 73 are uniformly arranged in positions corresponding to a first annular electrode sheet, and a pair of negative terminals 74 are uniformly arranged in positions corresponding to a second annular electrode sheet 72, where the positive and negative terminals are spaced separately and alternately from each other. In this embodiment, the positive and negative terminals are provided alternately and uniformly for the purpose of further improving the stability of electrical connection between the power source plug and the power source socket.

It shall be noted that there are two pairs of positive and negative terminals schematically illustrated in the embodiment of the invention, but the number of positive and negative terminals can be particularly selected for a design structure of the power source plug in practice.

Preferably the power source socket in the embodiments above is arranged on a body of a terminal device including a sound box.

In a real application, the power source socket and the power source plug in the technical solutions above can be magnetically connected, where a permanent magnet or an electromagnet is arranged on the power source plug and/or the power source socket; and when the power source plug is magnetically attracted into the power source socket, the positive and negative terminals of the power source plug are arranged retractable, for example, the terminals are embodied as retractable springs (or pogo-pins), to thereby further improve the reliability of connection between the power source plug and the power source socket.

Figure 8:
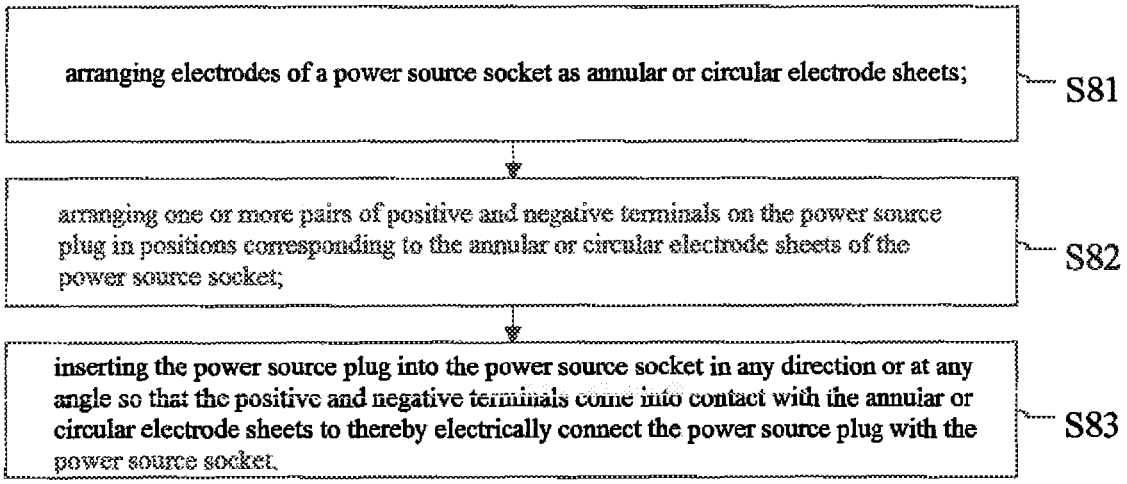
FIG. 8 illustrates a flow diagram of a method for implementing the connector according to an embodiment of the invention.

FIG. 8 illustrates a flow chart of a method for implementing a connector, where the method includes:

S81, arranging electrodes of a power source socket as annular or circular electrode sheets.

The annular or circular electrode sheets can be located in a bottom plane where a power source socket is located, to thereby make full use of a space where the power source socket is located, or the annular electrode sheets can be positioned encircling the side of the power source socket to thereby reduce the size of the power source socket so as to make the connector more compact in structure.

S82, arranging one or more pairs of positive and negative terminals on the power source plug in positions corresponding to the annular or circular electrode sheets of the power source socket.

Preferably the positive and negative terminals come into contact with the annular or circular electrode sheets uniformly and symmetrically, and the positive and negative terminals are spaced alternately and uniformly. For example, among a plurality of terminals (e.g., four terminals) in contact with each of the electrode sheets, there may be an even distance between every adjacent two terminals, or there is an even corresponding central angle between every adjacent two of these terminals.

S83, inserting the power source plug into the power source socket in any direction or at any angle so that the positive and negative terminals come into contact with the annular or circular electrode sheets to thereby electrically connect the power source plug with the power source socket.

In the connector according to this embodiment, the annular or circular electrode sheets are arranged on the power source socket so that the positive and negative terminals can come into contact with the annular or circular electrode sheets while the power source plug is inserted into the power source socket in any direction or at any angle, to thereby electrically connect the power source plug with the power source socket.

In a preferred embodiment, the electrodes of the power source socket of the connector are annular electrode sheets, and a spare jack is positioned at the center of the power source socket.

Preferably the spare jack is arranged as an earphone jack, and an earphone plug is arranged on the power source plug in a position corresponding to the earphone jack. When the earphone plug is inserted into the earphone jack, the earphone plug is electrically connected with the earphone jack, and also the power source plug is mechanically connected with the power source socket. In this way, audio data can be transmitted using the spare jack, and also the power source plug can be installed and fixed onto the power source socket using the spare jack.

In this embodiment, the earphone jack is positioned at the center of the power source socket, and the earphone plug is arranged on the power source plug in a position corresponding to the earphone jack, so that the connector can operate as both the earphone jack and the power source socket to thereby make use of the space effectively so as to reduce the number of external interfaces of the device thus making the device simpler in appearance.

Of course, the power source plug end can alternatively be provided with a mechanical structure of no any electrical function but only similar to the earphone plug, so that when the power source plug is inserted into the power source socket, the power source plug will be electrically connected with the power source socket due to the engagement structure similar to that of the earphone plug, and at this time the earphone plug and the earphone jack can only operate for the purpose of connection but will not transmit audio data.

In another preferred embodiment, the power source plug includes a circular through-hole structure mating with the spared jack. The electrodes of the power source socket of the connector are annular electrode sheets, a spare jack is positioned at the center of the power source socket, and the power source plug includes a circular through-hole structure mating with the spare jack.

Preferably the spare jack is arranged as an earphone jack, and when an external earphone plug is inserted into the earphone jack through the circular through-hole structure of the power source plug, the earphone plug is electrically connected with the earphone jack.

In this embodiment, the power source plug is arranged with the circular through-hole structure so that the external earphone plug is inserted into the earphone jack through the circular through-hole structure of the power source plug, thus providing additional cooperation manner between the connector and the earphone so that the connector can operate as both the earphone jack and the power source socket to thereby make use of the space effectively, reduce the number of external interfaces of the device, thus making the device simpler in appearance. Also the circular through-hole structure makes sure that the earphone plug can be inserted into the jack at any angle/in any direction.

Even if the annular power source plug including the circular through-hole structure is inserted into the power source socket, the external earphone plug can still be inserted into the earphone socket through the circular hole of the annular power source plug to perform transmission of audio data normally.

Preferably in this embodiment such a protruding section protruding from the bottom surface of the power source socket is arranged on the spare jack that the earphone jack can mate with different types of earphone plugs to thereby ensure the earphone plug to be completely inserted into the earphone jack so that the earphone plug is electrically connected with the earphone jack, and also the power source plug is mechanically connected with the power source socket.

Further preferably a projection is arranged on the side of the protruding section, and a groove is arranged on the side of the circular through-hole structure in a position corresponding to the projection, where the projection is engaged with the groove to thereby improve the stability of mechanical connection between the power source plug and the power source socket.

In an embodiment of the invention, the electrodes of the power source socket are arranged as a number of concentrically arranged annular electrode sheets, each of which corresponds to a polarity type, where an insulation layer is arranged between two adjacent annular electrode sheets of different polarity types, and positive terminals are arranged on the power source plug in positions corresponding to a positive annular electrode sheet, whereas negative terminals are arranged on the power source plug in positions corresponding to a negative annular electrode sheet. This arrangement including a plurality of electrode sheets can both improve the flexibility of the connector and ensure the stability of the electrical connection.

Preferably the power source socket in the embodiments above is arranged on a body of a terminal device including a sound box.

In a real application, the power source socket and the power source plug in the technical solutions above can be magnetically connected, where a permanent magnet or an electromagnet is arranged on the power source plug and/or the power source socket; and when the power source plug is magnetically attracted into the power source socket, the positive and negative terminals of the power source plug are arranged retractable, for example, the terminals are embodied as retractable springs (or pogo-pins), to thereby further improve the reliability of connection of the power source plug with the power source socket.

In summary, the invention discloses a connector and a method for implementing the connector, where the connector is arranged with the annular or circular electrode sheets on the power source socket, and one or more pairs of positive and negative terminals are positioned correspondingly on the power source plug, so that when the power source plug is inserted into the power source socket in any direction or at any angle, the positive and negative terminals can come into contact with the annular or circular electrode sheets to thereby electrically connect the power source plug with the power source socket. Mover preferably when the electrodes of the power source socket are annular electrode sheets, the earphone jack is positioned at the center of the power source socket so that the connector can operate as both the earphone jack and the power source socket to thereby make use of the device effectively, reduce the number of external interfaces of the device, thus making the device simpler in appearance.

The foregoing disclosure is merely illustrative of the preferred embodiments of the invention but not intended to limit the scope of the invention. Any modifications, equivalent substitutions, adaptations, etc., made without departing from the spirit and scope of the invention shall fall into the scope of the invention.

The invention claimed is:

1. A connector, comprising a power source socket, and a power source plug mating with the power source socket, electrodes of the power source socket are annular electrode sheets, and a spare jack is arranged at the center of the power source socket, and one or more pairs of positive and negative terminals are arranged on the power source plug in positions corresponding to the annular electrode sheets of the power source socket; and when the power source plug is inserted into the power source socket in any direction or at any angle, the positive and negative terminals come into contact with the annular electrode sheets to thereby electrically connect the power source plug with the power source socket.

2. The connector according to claim 1, wherein the spare jack is an earphone jack, and an earphone plug is arranged on the power source plug in a position corresponding to the earphone jack; and when the earphone plug is inserted into the earphone jack, the earphone plug is electrically connected with the earphone jack, or the power source plug is mechanically connected with the power source socket.

3. The connector according to claim 1, wherein power source socket and the power source plug are magnetically connected, and a permanent magnet or an electromagnet is arranged on the power source plug and/or the power source socket.

4. The connector according to claim 1, wherein the electrodes of the power source socket are a plurality of concentrically arranged annular electrode sheets, each of which corresponds to a polarity type, and an insulation layer is arranged between two adjacent annular electrode sheets of different polarity types; and positive terminals are arranged on the power source plug in positions corresponding to a positive annular electrode sheet of the plurality of annular electrode sheets; and negative terminals are arranged on the power source plug in positions corresponding to a negative annular electrode sheet of the plurality of annular electrode sheets.

5. The connector according to claim 1, wherein the annular electrode sheets are located on a bottom plane where the power source socket is located; or the annular electrode sheets are positioned encircling a side of the power source socket.

6. The connector according to claim 1, wherein the positive and negative terminals are retractable; and the positive and negative terminals come into contact with the annular electrode sheets uniformly and symmetrically.

7. The connector according to claim 1, wherein the power source socket is arranged on a body of a terminal device and the terminal device includes a sound box.

8. The connector according to claim 1, wherein the power source plug comprises a circular through-hole structure mating with the spared jack.

9. The connector according to claim 8, wherein the spare jack is an earphone jack, and when an external earphone plug is inserted into the earphone jack through the circular through-hole structure of the power source plug, the earphone plug is electrically connected with the earphone jack, or the power source plug is mechanically connected with the power source socket.

10. The connector according to claim 8, wherein a protruding section protruding from the bottom surface of the power source socket is arranged on the spare jack, wherein a projection is arranged on a side of the protruding section, a groove is arranged on a side of the circular through-hole structure in a position corresponding to the projection, when the projection is engaged with the groove, the power source plug is mechanically connected with the power source socket.

11. A method for implementing a connector, the method comprising:

arranging electrodes of a power source socket as annular electrode sheets, and arranging a spare jack at the center of the power source socket;

arranging one or more pairs of positive and negative terminals on the power source plug in positions corresponding to the annular electrode sheets of the power source socket; and inserting the power source plug into the power source socket in any direction or at any angle so that the positive and negative terminals come into contact with the annular electrode sheets to thereby electrically connect the power source plug with the power source socket.

12. The method according to claim 11, wherein the method further comprises:

arranging a permanent magnet or an electromagnet on the power source plug and/or the power source socket so that the power source socket and the power source plug are magnetically connected.

13. The method according to claim 11, wherein when the electrodes of the power source socket are a plurality of concentrically arranged annular electrode sheets, the method further comprises:

making each of the annular electrode sheets corresponding to a polarity type, and arranging an insulation layer between two adjacent annular electrode sheets of different polarity types; and the arranging one or more pairs of positive and negative terminals on the power source plug in positions corresponding to the annular electrode sheets of the power source socket comprises:

arranging positive terminals on the power source plug in positions corresponding to a positive annular electrode sheet of the plurality of annular electrode sheets; and arranging negative terminals on the power source plug in positions corresponding to a negative annular electrode sheet of the plurality of annular electrode sheets.

* * * * *